US006119273A

United States Patent [19]

Cho

[11] Patent Number: 6,119,273

[45] Date of Patent: Sep. 19, 2000

[54] FREE-SIZE CAP WITH SIZE ADJUSTING BAND

[75] Inventor: Byung-Woo Cho, Seoul, Rep. of Korea

[73] Assignee: Yupoong & Co., Ltd., Seoul, Rep. of Korea

[21] Appl. No.: 09/383,824

[22] Filed: Aug. 27, 1999

[51] Int. Cl.[7] ..... A42B 1/22

[52] U.S. Cl. ..... 2/195.3; 2/195.4; 2/200.1; 2/183

[58] Field of Search ..... 2/195.1, 195.2, 2/195.3, 195.4, 200.1, 183, 181

[56] References Cited

U.S. PATENT DOCUMENTS

| | | | |
|---|---|---|---|
| 3,309,713 | 3/1967 | Kaufman | 2/183 |
| 3,337,877 | 8/1967 | Lipkin | 2/172 |
| 5,615,415 | 4/1997 | Beckerman | 2/195.3 |
| 5,715,540 | 2/1998 | Cho | 2/195.3 |
| 5,966,742 | 10/1999 | Cunliffe | 2/195.3 |
| 6,016,572 | 1/2000 | Park | 2/195.2 |
| 6,049,911 | 4/2000 | Bromberg | 2/195.3 |
| 6,052,831 | 4/2000 | Park | 2/195.2 |

*Primary Examiner*—Michael A. Neas
*Attorney, Agent, or Firm*—Armstrong, Westerman, Hattori, McLeland & Naughton

[57] ABSTRACT

A free-size cap with a size adjusting band is disclosed. In the cap, six gores, integrated into a crown, are made of a stretchable woven fabric, with a weft directional elongation of the gores being higher than a warp directional elongation of the gores. A sweat band is attached along a lower edge of the integrated gores. The sweat band is made of a stretchable woven fabric, with a weft directional elongation of the sweat band being higher than the weft directional elongation of the gores. The warp directional elongation of the gores is 25%±2%, and the weft directional elongation of the gores is 50%±5%. The weft directional elongation of the sweat band is 65%±5%. The free-size cap is thus primarily and manually adjusted in size by its size adjusting band and is finely and automatically adjusted in size by the elasticity of the stretchable woven fabric of both the crown and the sweat band. The cap thus allows a user to feel comfortable while wearing the cap. The cap is made of stretchable woven fabric designed to have a high elasticity in both wefts and warps, thus being prevented from easily wrinkling in a vertical or horizontal direction while having a desired automorphism.

3 Claims, 3 Drawing Sheets

FREE-SIZE CAP WITH SIZE ADJUSTING BAND

BACKGROUND OF THE INVENTION

1. Field of the Invention

The present invention relates, in general, to free-size caps with size adjusting bands and, more particularly, to a multi-effect free-size cap, designed to be primarily and manually adjusted in size by its size adjusting band and to be finely and automatically adjusted in size by the elasticity of a stretchable woven fabric of both the crown and the sweat band, thus allowing a user to feel comfortable while wearing the cap, the stretchable woven fabric of the crown being specifically designed to have a high elasticity in both wefts and warps, thus being prevented from easily wrinkling in a vertical or horizontal direction while having a desired automorphism.

2. Description of the Prior Art

As well known to those skilled in the art, free-size caps or caps of the one-size-fits-all type, designed to be manufactured at a single reference size and to be commonly usable by users having different head sizes within a range, are classified into the following two types.

In a conventional free-size cap of the first type, a rounded cutout, having a size of 3~4 inches, is formed on the edge of the crown at the rear end, with a size adjusting band and a buckle being mounted to both ends of the cutout. In this cap, the cutout, the band and the buckle form a size adjusting means.

In a free-size cap of the second type, the cap is designed to be free from such a size adjusting means, but to be commonly usable by users, having head sizes different from each other within a difference of about 2.5 inches (6.35 cm) as disclosed in Korean Patent No. 92219 or U.S. Pat. No. 5,715,540. In the above cap, both the crown and the sweat band are made of a stretchable woven fabric that is expandable in a weft direction or a horizontal direction.

However, the first type of conventional free-size cap with a size adjusting band is problematic in that it is almost impossible for a user to precisely adjust the size of the size adjusting band in accordance with his head size. Therefore, when the size adjusting band is undesirably adjusted in a way such that the size of the cap is smaller than that of a user's head, the cap severely squeezes the head, thus making the user feel uncomfortable after wearing the cap for a lengthy period of time. On the other hand, when the size adjusting band is undesirably adjusted in a way such that the size of the cap is larger than that of a user's head, the cap is easily removed from the head in the wind. The cap, with the size adjusting band undesirably adjusted to be larger than the size of a user's head, may cause safety hazards when the user drives a car, walks along a road, or climbs a rocky mountain.

In the above free-size cap with such a size adjusting band, the crown is made of a non-stretchable woven fabric, thus failing to accomplish a desired automorphism or to meet a requirement of users, particularly, young people, wanting to show their personalities with tightly fitted caps. Such a non-stretchable woven fabric crown has another problem in that it is very difficult to prevent the crown from wrinkling or to remove wrinkles from the crown.

On the other hand, the second type of conventional free-size cap, disclosed in Korean Patent No. 92219 or U.S. Pat. No. 5,715,540, is problematic in that it is almost impossible to further adjust the size of the cap as desired after the cap is worn on a user's head. That is, this type of cap does not allow a user to slightly tighten or loosen the cap after wearing the cap on his head. Since both the crown and the sweat band of this type of cap are made of a stretchable woven fabric designed to be expandable in a weft direction or a horizontal direction, it is very difficult to prevent the crown from wrinkling in the weft direction or to remove weft directional wrinkles from the crown. Another problem of the above cap resides in that the cap fails to accomplish a desired automorphism or to meet a requirement of users, particularly, young people, wanting to show their personalities with tightly fitted caps in the same manner as that described for the first type of free-size cap.

SUMMARY OF THE INVENTION

Accordingly, the present invention has been made keeping in mind the above problems occurring in the prior art, and an object of the present invention is to provide a free-size cap, which has a conventional size adjusting means consisting of a rounded cutout formed on the edge of the crown at the rear end with conventional size adjusting band and buckle provided on the cutout, and which is primarily and manually adjusted in size by the size adjusting means and is finely and automatically adjusted in size by a weft directional elasticity of a stretchable woven fabric of both the crown and the sweat band, thus allowing a user to feel comfortable while wearing the cap, the stretchable woven fabric of the crown being specifically designed to have a high elasticity in both wefts and warps, thus being prevented from easily wrinkling in a weft or warp direction while having a desired automorphism capable of meeting a requirement of users, particularly, young people, wanting to show their personalities with tightly fitted caps.

In order to accomplish the above object, the present invention provides a free-size cap with a size adjusting band, comprising: a plurality of gores integrated into a crown and made of a stretchable woven fabric, with a weft directional elongation of the gores being higher than a warp directional elongation of the gores; and a sweat band attached along a lower edge of the integrated gores and made of a stretchable woven fabric, with a weft directional elongation of the sweat band being higher than the weft directional elongation of the gores.

In the above free-size cap, the warp directional elongation of the gores is 25%±2%, and the weft directional elongation of the gores is 50%±5%.

On the other hand, the weft directional elongation of the sweat band is 65%±5%.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
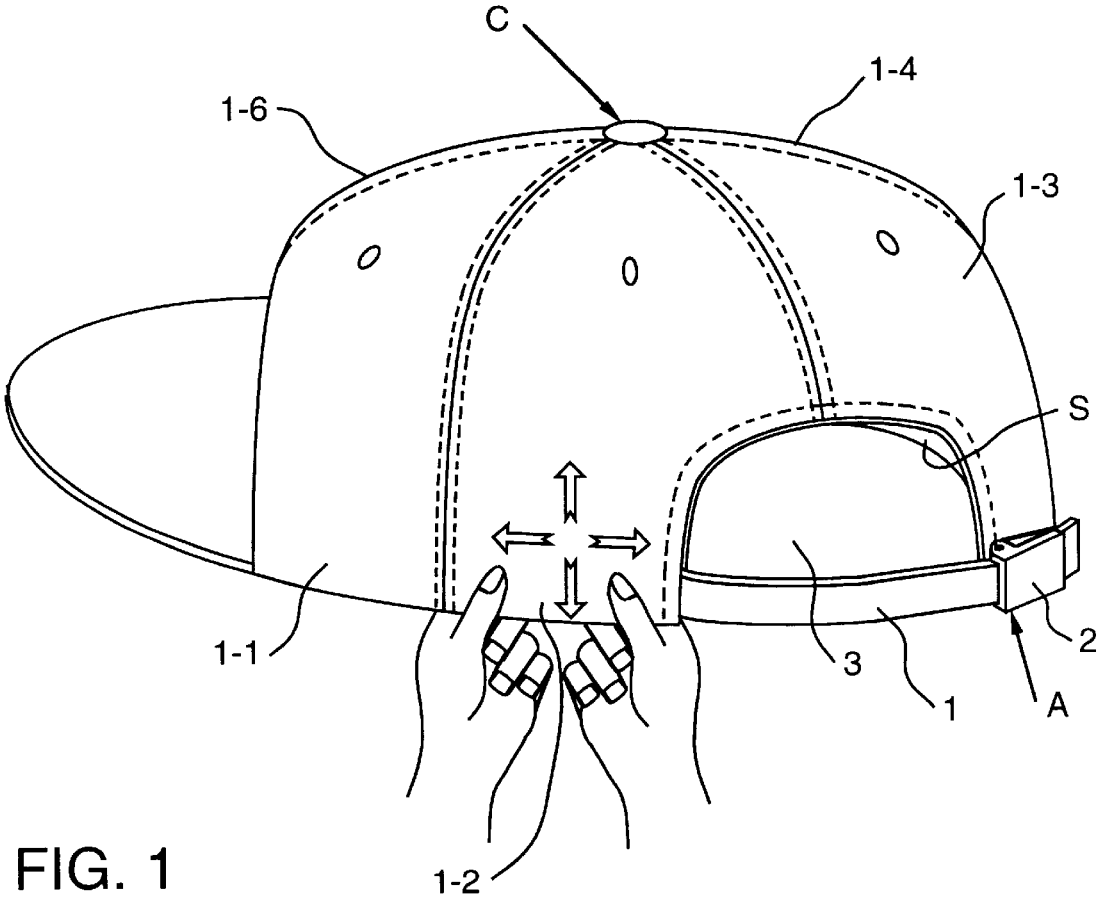
FIG. 1 is a perspective view of a free-size cap with a size adjusting band in accordance with the preferred embodiment of the present invention.
Figure 2:
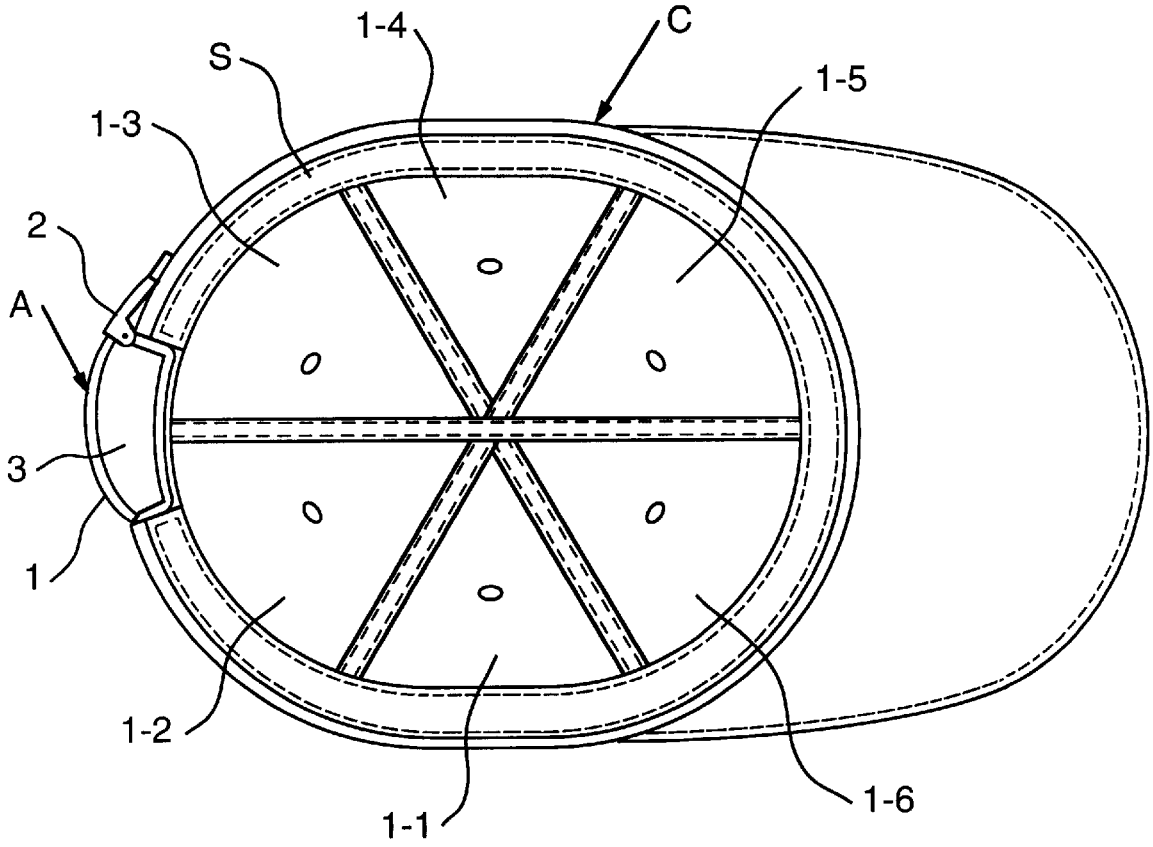
FIG. 2 is a bottom view of the free-size cap of this invention.
Figure 3:
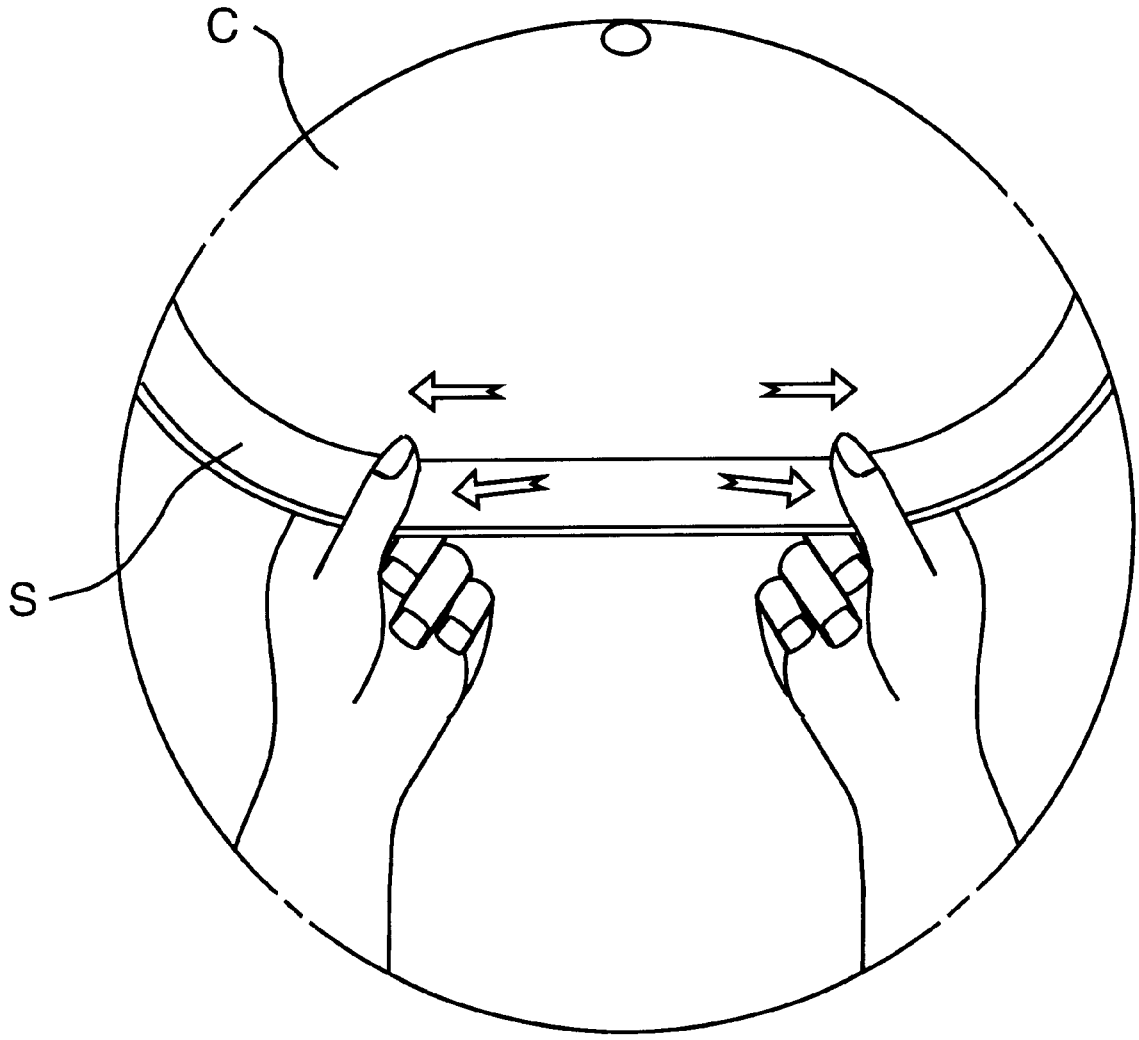
FIG. 3 is a perspective view, showing an operational effect of a stretchable woven fabric of both the sweat band and the crown of the above free-size cap when the fabric is stretched in a weft direction.

FIGS. 1 to 3 show a free-size cap with a size adjusting band in accordance with an embodiment of the present invention. As shown in the drawings, the crown C of the free-size cap according to the primary embodiment of this invention is formed by integrating six triangular gores 1-1, 1-2, 1-3, 1-4, 1-5 and 1-6 together. The six gores 1-1 to 1-6 are individually made of a stretchable woven fabric, which is elastically expandable in weft and warp directions. The cap is thus elastically stretchable in the weft direction, or a horizontal direction, and in the warp direction, or a vertical direction.

A sweat band S, interiorly attached along the bottom edge of the crown C, is made of a stretchable woven fabric, with spandex yarns used as wefts and non-stretchable yarns used as warps. Therefore, the sweat band S is only stretchable in a weft direction, or a horizontal direction.

The cap of this invention also has a size adjusting means A. The size adjusting means A consists of a rounded cutout 3, formed on the edge of the crown at the rear end to have a 4 inch width and a 2 inch height, with a size adjusting band 1 and a buckle 2 being mounted to both ends of the cutout 3. After a user wears the cap on his head with the band 1 being loosened from the buckle 2, the user buckles the band 1 while primarily and manually adjusting the size of the cap by operating the band and buckle, thus approximately fitting the size of the cap to his head. In such a case, it is preferable to approximately adjust the size of the cap in a way such that the cap is slightly tightened on the head. When the cap is worn on a user's head as described above, a slight gap may remain between the head and both the sweat band S and the lower portion of the crown C. However, in the cap of this invention, such a slight gap is finely and automatically adjusted by the weft directional elasticity of the six gores 1-1 to 1-6, since they are made of a stretchable woven fabric.

In the primary embodiment, the six stretchable gores 1-1 to 1-6 individually have a warp directional elongation of 25% and a weft directional elongation of 50%.

On the other hand, the sweat band S has a weft directional elongation of 65%.

Both the integration of the six gores 1-1 to 1-6 into a single structure and the integration of the sweat band S with the lower edge of the integrated six gores 1-1 to 1-6 are accomplished through a sewing process using spandex sewing yarns. Therefore, it is possible for the sewing yarns to be expandable or contractible synchronously with both the integrated portions of the six gores 1-1 to 1-6 and the integrated portion of the sweat band S with the six gores 1-1 to 1-6.

In a brief description, the crown C of the cap consists of the six stretchable woven fabric gores 1-1 to 1-6, individually having a warp directional elongation of 25%±2% and a weft directional elongation of 50%±5%. Therefore, it is easy to remove the weft directional wrinkles or the warp directional wrinkles from the crown C of this invention or to prevent the crown C from wrinkling in the weft or warp direction. This allows the crown of the cap to maintain its designed appearance for a lengthy period of time.

The stretchable woven fabric of each of the six gores 1-1 to 1-6 has a high flexibility and tightness in proportion to the elongation, and so the cap accomplishes a desired automorphism and meets a requirement of users, particularly, young people, wanting to show their personalities with tightly fitted caps. The cap of this invention is not easily removed from a user's head in the wind. That is, since the stretchable woven fabric of the cap has a high elasticity in the weft and warp directions, the cap is substantially fitted over a user's head, and so the cap accomplishes the above-mentioned objects.

A user wears the cap of this invention on his head with the band 1 being loosened from the buckle 2. Thereafter, the user buckles the band 1 while primarily and manually adjusting the size of the cap by operating the band and buckle, thus approximately fitting the size of the cap to his head. In such a case, the size of the cap is approximately adjusted in a way such that the cap is slightly tightened on the head. When the cap is worn on the head and is primarily adjusted in size by the band and buckle, a slight gap between the head and both the sweat band S and the lower portion of the crown C is finely adjusted by the weft directional elasticity of both the sweat band S and the six gores 1-1 to 1-6 since they are made of a stretchable woven fabric having a weft directional elongation of 50%±5%. Therefore, the cap of this invention allows a user to feel comfortable while wearing it.

When a user wears the cap of this invention for a lengthy period of time, the cap may squeeze the head, thus making the user feel uncomfortable after wearing the cap for such a lengthy period of time. In such a case, the band 1 is unbuckled and slightly loosened. After the size of the band 1 is readjusted as described above, the band 1 is buckled.

When the size adjusting band 1 is adjusted to be larger in size than that of a user's head, the cap may be easily removed from the head in the wind or while getting physical exercise. In order to maintain the cap on the head in such a case, the band 1 is unbuckled prior to being slightly tightened. Thereafter, the band 1 is again buckled.

When a user wears the cap of this invention, he buckles the band 1 while primarily and manually adjusting the size of the cap within a size difference range of 3~4 inches by operating the band and buckle. That is, the size of the cap is primarily and approximately fitted to the user's head. When the cap is worn on the head while being approximately adjusted in size by the band and buckle as described above, a slight gap between the head and both the sweat band S and the lower portion of the crown C is finely and automatically adjusted by the weft directional elasticity of both the sweat band S and the six gores 1-1 to 1-6 of the crown C since they are made of a stretchable woven fabric having a weft directional elongation of 50%±5%. Due to the combined operational function of both the size adjusting means, consisting of the band 1 and the buckle 2 provided at the cutout 3, and the weft directional elasticity of both the sweat band S and the crown C, the free-size cap of this invention is manufactured at a single reference size and is commonly usable by users having different head sizes within a range of, for example, 3~4 inches while being precisely adjusted in size in order to substantially meet the size of a user's head. The cap thus allows the user to feel comfortable while wearing it.

In the crown C of the cap, the six stretchable woven fabric gores 1-1 to 1-6 are designed to individually have a warp directional elongation of 25%±2%. In the present invention, such a warp directional elongation is determined in consideration of the fact that the heads of people are different from each other within a difference of about 25%±2% in a vertical direction.

On the other hand, the weft directional elongation of the six stretchable woven fabric gores 1-1 to 1-6 is set to 50%±5%. Such a weft directional elongation is determined as follows. That is, when the weft directional elongation of the six gores 1-1 to 1-6 is set to 50%±2% in a conventional manner, the cap squeezes a user's head, thus making the user feel uncomfortable after wearing the cap for a lengthy period of time. In accordance with repeatedly performed experiments, it is noted that such a problem is almost completely overcome with the weft directional elongation of the six gores 1-1 to 1-6 being set to 50%±5%.

When the stretchable woven fabric for the gores 1-1 to 16 is produced using spandex yarns, having an elongation of 50%, as wefts, each of the gores 1-1 tp 1-6 has an elastic recovery of 100%.

In the cap of this invention, the sweat band S is made of a stretchable woven fabric having a weft directional elongation of 65%±5%, and so the band S has a high flexibility, a high elasticity and a high ventilation effect, and has a desired tightness, a desired elongation and a desired elastic recovery. Therefore, even when the sweat band S is brought into contact with a user's head for a lengthy period of time, the band S effectively absorbs sweat from the head and retains a desired tightness relative to the head. Therefore, the cap allows the user to feel comfortable while wearing it for a lengthy period of time.

When spandex yarns, having an elongation of 70%, are used as wefts for the woven fabric of the sweat band S, the sweat band S has an elastic recovery of 98%.

The integration of the six gores 1-1 to 1-6 into a single structure is accomplished through a sewing process using spandex sewing yarns. Therefore, it is possible for the sewing yarns to be smoothly expandable or contractible synchronously with the integrated portions of the six gores 1-1 to 1-6. The free-size cap, using such spandex sewing yarns, thus overcomes the problems experienced in a free-size cap using conventional nonstretchable sewing yarns. That is, when such nonstretchable sewing yarns are used for integrating the gores 1-1 to 1-6 into a single structure, there is a remarkable difference in the elongation between the nonstretchable sewing yarns and the stretchable woven fabrics of the gores. Thus, such nonstretchable sewing yarns may be easily cut or may disturb a smooth expansion of the woven fabrics of the gores when the cap is worn on a user's head. Such a problem is almost completely overcome by the cap of this invention using the spandex sewing yarns.

The sweat band S is attached along the lower edge of the integrated gores 1-1 to 106 through a sewing process using spandex sewing yarns. The spandex sewing yarns, used for integrating the band S with the gores 1-1 to 1-6, yield the same operational effect as that described for the sewing yarns used in the integration of the six gores 1-1 to 1-6.

In the second embodiment of this invention, the stretchable woven fabric for both the gores and the sweat band is fabricated using spandex covered yarns as wefts and warps. The spandex covered yarns, used as the wefts and warps of the stretchable woven fabric of this invention, are individually made by covering a spandex yarn, or a core yarn, with a cotton yarn or a mix-spinned yarn of natural fiber and synthetic fiber as a covering yarn.

The remaining process of forming the cap according to the second embodiment is performed in same manner as that described for the primary embodiment.

In the present invention, it should be understood that a female band with holes and a male band with projections may be substituted for the band and buckle of the size adjusting means. In addition, the number of the gores, individually made of a stretchable woven fabric, may be five in place of six. The weft directional elongation of the stretchable woven fabric for the gores may be set to 30%±2%, while the weft directional elongation of the stretchable woven fabric for the sweat band may be set to 50%±5%.

As described above, the present invention provides a free-size cap with a size adjusting band. The cap of this invention has a conventional size adjusting means, consisting of a rounded cutout formed on the edge of the crown at the rear end with conventional size adjusting band and buckle provided on the cutout. The size of the cap is primarily and manually adjusted by the size adjusting means and is, thereafter, finely and automatically adjusted by the weft directional elasticity of a stretchable woven fabric of both the crown and the sweat band. The cap thus allows a user to feel comfortable while wearing the cap. The stretchable woven fabric of the crown is specifically designed to have a high elasticity in both wefts and warps, thus being prevented from easily wrinkling in a weft or warp direction. In addition, it is easy to remove weft or warp directional wrinkles from the crown. The cap also has a desired automorphism capable of meeting a requirement of users, particularly, young people, wanting to show their personalities with tightly fitted caps.

The free-size cap of this invention is appropriately fitted to a user's head, thus being not easily removed from the head even in the wind. Another advantage of the cap resides in that it has a high flexibility, a high elasticity and a high ventilation effect, and has a desired tightness, a desired elongation and a desired elastic recovery. Therefore, the cap effectively absorbs sweat from the head and retains a desired tightness relative to the head, and so the cap allows a user to feel comfortable while wearing it for a lengthy period of time.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A free-size cap with a size adjusting band, comprising:

a plurality of gores integrated into a crown and made of a stretchable woven fabric, with a weft directional elongation of the gores being higher than a warp directional elongation of the gores; and a sweat band attached along a lower edge of the integrated gores and made of a stretchable woven fabric, with a weft directional elongation of said sweat band being higher than the weft directional elongation of said gores.

2. The free-size cap according to claim 1, wherein the warp directional elongation of the gores is 25%±2%, and the weft directional elongation of the gores is 50%±5%.

3. The free-size cap according to claim 1, wherein the weft directional elongation of the sweat band is 65%±5%.

* * * * *